US006673761B2

(12) United States Patent
Mitra et al.

(10) Patent No.: US 6,673,761 B2
(45) Date of Patent: Jan. 6, 2004

(54) BACTERICIDAL CLEANING WIPE

(75) Inventors: Shuman Mitra, Dublin, CA (US); Richard E. Simon, Tracy, CA (US); Wayne B. Scott, Walnut Creek, CA (US); Kenneth Vieira, Livermore, CA (US); Glen A. Shaffer, Vallejo, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 10/305,599

(22) Filed: Nov. 27, 2002

(65) Prior Publication Data

US 2003/0148917 A1 Aug. 7, 2003

Related U.S. Application Data

(63) Continuation of application No. 09/737,641, filed on Dec. 14, 2000, now abandoned.

(51) Int. Cl.[7] ..... C11D 3/48; C11D 1/75

(52) U.S. Cl. ..... 510/384; 510/130; 510/131; 510/238; 510/382; 510/384; 510/391; 510/235; 510/295; 510/432; 510/477; 510/480; 510/367; 510/365; 510/503; 510/504

(58) Field of Search ..... 510/130, 131, 510/238, 382, 384, 391, 235, 295, 432, 477, 480, 367, 365, 503, 504

(56) References Cited

U.S. PATENT DOCUMENTS

| | | | | | |
|---|---|---|---|---|---|
| 3,965,026 | A | | 6/1976 | Lancz | |
| 4,265,772 | A | | 5/1981 | Jones | |
| 4,455,250 | A | * | 6/1984 | Frazier | 252/106 |
| 4,540,505 | A | * | 9/1985 | Frazier | 252/106 |
| 4,597,887 | A | * | 7/1986 | Colodney et al. | 252/106 |
| 4,615,937 | A | | 10/1986 | Bouchette | |
| 4,666,621 | A | | 5/1987 | Clark et al. | |
| 4,725,489 | A | * | 2/1988 | Jones et al. | 428/289 |
| 4,781,974 | A | | 11/1988 | Bouchette et al. | |
| 4,895,667 | A | | 1/1990 | Fox et al. | |
| 4,895,669 | A | | 1/1990 | Choy et al. | |
| 5,037,647 | A | | 8/1991 | Chowhan et al. | |
| 5,252,245 | A | | 10/1993 | Garabedian, Jr. et al. | |
| 5,284,875 | A | | 2/1994 | Martin | |
| 5,322,856 | A | | 6/1994 | Martin | |
| 5,437,807 | A | | 8/1995 | Garabedian, Jr. et al. | |
| 5,454,984 | A | | 10/1995 | Graubart et al. | |
| 5,468,423 | A | | 11/1995 | Garabedian, Jr. et al. | |
| 5,522,942 | A | | 6/1996 | Graubart et al. | |
| 5,523,024 | A | | 6/1996 | Garabedian, Jr. et al. | |
| 5,536,494 | A | | 7/1996 | Park | |
| 5,576,284 | A | * | 11/1996 | van Buskirk et al. | 510/384 |
| 5,585,342 | A | | 12/1996 | Choy et al. | |
| 5,728,667 | A | | 3/1998 | Richter | |
| 5,762,948 | A | | 6/1998 | Blackburn et al. | |
| 5,814,591 | A | | 9/1998 | Mills et al. | |
| 5,817,615 | A | | 10/1998 | Garabedian Jr. et al. | |
| 5,851,981 | A | | 12/1998 | Choy et al. | |
| 5,908,707 | A | | 6/1999 | Cabell et al. | |
| 5,925,681 | A | | 7/1999 | Crisanti et al. | |
| 5,929,016 | A | | 7/1999 | Harrison | |
| 5,939,374 | A | * | 8/1999 | Richter et al. | 510/384 |
| 6,004,916 | A | | 12/1999 | Mills et al. | |
| 6,013,615 | A | | 1/2000 | Zhou et al. | |
| 6,017,561 | A | | 1/2000 | Zhou et al. | |
| 6,017,869 | A | | 1/2000 | Lu et al. | |
| 6,022,841 | A | | 2/2000 | Lu et al. | |
| 6,090,771 | A | | 7/2000 | Burt et al. | |
| 6,096,701 | A | | 8/2000 | Mondin et al. | |
| 6,165,965 | A | * | 12/2000 | Schalitz et al. | 510/384 |
| 6,184,195 | B1 | * | 2/2001 | Cheung et al. | 510/432 |
| 6,255,270 | B1 | * | 7/2001 | Barger et al. | 510/244 |
| 6,294,186 | B1 | * | 9/2001 | Beerse et al. | 424/405 |
| 6,353,022 | B1 | * | 3/2002 | Schneider et al. | 514/530 |

FOREIGN PATENT DOCUMENTS

| | | |
|---|---|---|
| EP | 580838 | 10/1993 |
| EP | 606712 | 7/1994 |
| EP | 647706 | 4/1995 |
| EP | 691397 | 1/1996 |
| EP | 815189 | 12/1996 |
| EP | 937125 | 10/1999 |
| WO | WO 93/16162 | 8/1993 |
| WO | WO 96/14835 | 5/1996 |
| WO | WO 96/30473 | 10/1996 |
| WO | WO 97/40814 | 11/1997 |
| WO | WO 98/03713 | 1/1998 |
| WO | WO 98/16606 | 4/1998 |
| WO | WO 98/44791 | 10/1998 |
| WO | WO 98/55569 | 12/1998 |
| WO | WO 98/55570 | 12/1998 |
| WO | WO 99/58631 | 11/1999 |
| WO | WO 99/60852 | 12/1999 |
| WO | WO 00/03692 | 1/2000 |

* cited by examiner

*Primary Examiner*—Charles Boyer
(74) *Attorney, Agent, or Firm*—Fay, Sharpe, Fagan, Minnich & McKee

(57) ABSTRACT

An cleaning composition loaded on a cleaning wipe having improved biocidal release from the cleaning wipe. The cleaning composition includes a cationic biocide, a biocide release agent and water. The cationic biocide release agent has an ionic strength in the cleaning composition of at least about $5\times10^{-3}$ mol/l.

26 Claims, 1 Drawing Sheet

CLXE 2 12905-1 1/1
S.N. G.A.U.

BACTERICIDAL CLEANING WIPE

The present invention is a continuation of U.S. application Ser. No. 09/737,641 filed Dec. 14, 2000 now abandoned.

The present invention relates to an improved general purpose cleaning wipe which includes a wipe combined with a liquid cleaning composition having a biocide and a biocide release agent. Although the invention is principally directed to a cleaning wipe, the invention has broader applications and includes an improved liquid solution comprising a biocide and a biocide release agent that can be used alone or in combination with a towel, cloth, rag, sponge, squeegee, and the like.

BACKGROUND OF THE INVENTION

Cleaning wipes have long been used for a variety of purposes. Such cleaning wipes have contained various compounds to accomplish their intended purpose. For example, cleaning wipes have included inverse emulsions (i.e. water-in-liquid) to clean infants. Cleaning wipes have also included waxes to polish and clean furniture. Cleaning wipes have further included soaps and detergents to clean an individual's hands, counter tops, floors, and the like. Cleaning wipes have also included ammonia to clean glass surfaces. Alcohol and various other biocides have been included on cleaning wipes to disinfect a variety of surfaces.

One type of biocide that has been used in cleaning wipes is quaternary ammonium salts commonly referred to as quarts. Liquid cleaners applied to cleaning wipes typically include relatively large amounts of quart. It has been observed that only about 50% of the quat on a cleaning wipe is released from the wipe when the wipe is applied to a surface. As a result, added quat is included in the liquid cleaner to ensure that the desired amount of quat transfers to the cleaned surface. Although quats are excellent biocides, quats can cause skin irritation when used in too high of concentrations. Furthermore, liquid cleaners having a high quat content are subject to various local, state and/or federal regulations due to the toxicity of the quat in high concentrations. In addition to the regulatory and skin irritation concerns associated with quats, quats are typically the highest cost component of the cleaner, thus larger quat concentrations translate into higher product costs.

There have been various attempts to develop liquid cleaners having improved quat release from the cleaning wipes. Some cleaning formulations use a high weight percentage of isopropyl alcohol to promote quat release from the cleaning wipe. It has been observed that isopropyl alcohol in amounts of over about 12% can improve the quat release from the wipe. The use of isopropyl alcohol is also beneficial in that the alcohol has its own antimicrobial properties and cost substantially less than quats. Although the use of isopropyl alcohol in the cleaning formulation improves quat release from the wipe, a substantial amount of quat still remains on the cleaning wipe after use. In addition, local, state and/or federal governments have begun to promulgate regulations on the amount of isopropyl alcohol that can be used in cleaners. Indeed, in California, regulations have been proposed to regulate the use of cleaners containing over 5 weight percent isopropyl alcohol. As a result, cleaners having high concentrations of isopropyl alcohol may be less preferred.

In view of the present state of the art of cleaning wipes containing quats, there is a demand for a quat containing liquid cleaner that can be applied to a cleaning wipe formulated to have improved quat release without having to incorporate high weight percentages of isopropyl alcohol or any other type of alcohol.

SUMMARY OF THE INVENTION

The present invention is directed to an improved cleaning wipe impregnated with a liquid cleaning composition that includes a biocide and a biocide release agent. The cleaning composition is generally a liquid cleaner; however, the cleaning composition may be in a solid or semi-solid form. The cleaning composition can be concentrated or unconcentrated. The cleaning composition is generally applied to a cleaning wipe and loaded onto the cleaning wipe to a desired loading ratio; however, the cleaning composition can be used separately from a cleaning wipe. When the cleaning composition is loaded or impregnated onto a cleaning wipe, the cleaning composition is formulated to have a viscosity that allows such loading. Typically, the viscosity of the cleaning composition is less than about 1,000 centipoise ("cps") when the cleaning composition is loaded or impregnated onto a cleaning wipe. The viscosity of the cleaning composition can be greater than 1000 cps when the cleaning composition is used separately from a cleaning wipe.

In one aspect of the present invention, the dry cleaning wipe onto which the cleaning composition is loaded generally includes an absorbent and/or adsorbent material. In one embodiment, the cleaning wipe includes, but is not limited to, a nonwoven material. In one aspect of this embodiment, the nonwoven material includes, but is not limited to, nonwoven, fibrous sheet materials. In another aspect of this embodiment, the nonwoven material includes, but is not limited to, meltblown, coform, air-laid, spun bond, wet laid, bonded-carded web materials, and/or hydroentangled (also known as spunlaced) materials. In another embodiment, the cleaning wipe includes woven materials. In one aspect of this embodiment, the woven material includes, but is not limited to, cotton fibers, cotton/nylon blends and/or other textiles. In yet another embodiment, the cleaning wipe includes a sponge and/or sponge-like material. In one aspect of this embodiment, the sponge and/or sponge-like material includes, but is not limited to, regenerated cellulose and/or polyurethane foams. In still another embodiment, the cleaning wipe includes wood pulp, a blend of wood pulp, and/or synthetic fibers. In one aspect of this embodiment, the synthetic fibers include, but are not limited to, polyester, rayon, nylon, polypropylene, polyethylene, and/or cellulose polymers. In still another embodiment, the cleaning wipe includes a binder. In a further embodiment, the liquid loading capacity of the cleaning wipe is sufficient to retain the desired amount of cleaning composition on the cleaning wipe. In one aspect of this embodiment, the liquid loading capacity of the cleaning wipe is at least about 10% of the dry weight of the cleaning wipe. In another aspect of this embodiment, the liquid loading capacity of the cleaning wipe is about 50%–1000% of the dry weight of the cleaning wipe. This loading capacity is expressed as loading ½ to 10 times the weight (or, more accurately, the mass) of the dry cleaning wipe. In still another aspect of this embodiment, the liquid loading capacity of the cleaning wipe is about 200%–800% of the dry weight of the cleaning wipe. In yet another aspect of this embodiment, the liquid loading capacity of the cleaning wipe is about 250%–500% of the dry weight of the cleaning wipe. In still yet another aspect of this embodiment, the liquid loading capacity of the cleaning wipe is about 300%–450% of the dry weight of the cleaning wipe. In still a further embodiment, the cleaning composition is impregnated, dosed, loaded, metered, or otherwise dispensed onto the cleaning wipe. The loading of the cleaning wipe can be accomplished in several ways including, but not limited to, treating each individual wipe with a discrete amount of cleaning composition, mass treating a continuous web of cleaning wipes with the cleaning composition, soaking the entire web of cleaning wipes in the cleaning composition, spraying the cleaning composition in a stationary or moving web of cleaning wipes, and/or impregnating a stack of individually cut and sized cleaning wipes in a dispenser. In yet a further embodiment, the cleaning wipe has a density of about 0.01–1,000 grams per square meter (referred to as "basis weight"). In one aspect of this embodiment, the cleaning wipe has a density of about 25–120 grams/$m^2$. In still yet a further embodiment, the cleaning wipe is produced as a sheet or web which is cut, die-cut or otherwise sized into the desired appropriate shape and size. In another embodiment, the cleaning wipe has a wet tensile strength of about 25–250 Newton/m. In one aspect of this embodiment, the cleaning wipe has a wet tensile strength of about 75–170 Newton/m. Manufacturers of cleaning wipes that can be used in the present invention include, but are not limited to, Kimberly-Clark, E. I. Du Pont de Nemours and Company, Dexter, American Nonwovens, James River, BBA Nonwoven; and PGI. Specific, nonlimiting examples of cleaning wipes from these manufacturers are disclosed in Bouchette et al., U.S. Pat. Nos. 4,781,974 and 4,615,937; Clark et al, U.S. Pat. No. 4,666,621; Amundson et al., WO 98/03713; Cabell et al., U.S. Pat. No. 5,908,707; Mackey et al., WO 97/40814; Mackey et al., WO 96/14835; and Moore, EP 750063, all of which are incorporated herein by reference.

In another aspect of the present invention, the cleaning wipe is individually sealed with a heat-sealable or glueable thermoplastic overwrap (such as polyethylene, Mylar and the like). In one embodiment, the cleaning wipes are packaged as numerous, individual sheets which are impregnated with the cleaning composition of the present invention. In another embodiment, the cleaning wipes are formed as a continuous web during the manufacturing process and loaded into a dispenser, such as a canister with a closure or a tub with closure. The closure is used to seal the loaded cleaning wipes from the external environment and prevents premature volatilization of the components of the cleaning composition. In one aspect of this embodiment, the dispenser includes a plastic such as, but not limited to, high density polyethylene, polypropylene, polycarbonate, polyethylene pterethalate (PET), polyvinyl chloride (PVC), and/or other rigid plastic. In another aspect of this embodiment, the continuous web of cleaning wipes is threaded through an opening in the top of the dispenser. In still another aspect of this embodiment, the dispenser includes a severing arrangement to cut a portion of the cleaning wipe after being removed from the dispenser. The severing arrangement can include, but is not limited to, a knife blade, serrated edge or the like. In still yet another aspect of this embodiment, the continuous web of cleaning wipes is scored, folded, segmented, and/or partially cut into uniform or non-uniform sizes and/or lengths. In a further aspect of this embodiment, the cleaning wipes are interleafed so that the removal of one cleaning wipe advances the next in the opening of the dispenser.

In still another aspect of the present invention, the cleaning composition includes an effective amount of biocide to obtain the desired disinfecting qualities of the cleaning composition. The cleaning composition includes one or more biocides to achieve the desired disinfecting qualities of the cleaning composition. Such biocides can include, but are not limited to, alcohols, chlorinated hydrocarbons, organometallics, halogen-releasing compounds, metallic salts, pine oil, organic sulfur compounds, iodine compounds, silver nitrate, quaternary ammonium compounds (quats). and/or phenolics. In one embodiment, the cleaning composition includes a cationic biocide. In one aspect of this embodiment, the cationic biocide includes one or more of the quats. Quats are capable of imparting a broad spectrum antimicrobial or germicidal properties to the cleaning composition. In another aspect of this embodimen, one or more of the quats included in the cleaning composition have at least one higher molecular weight group and at least one lower molecular weight group linked to a common, positively charged nitrogen atom. The one or more higher molecular weight groups include, but are not limited to, higher alkyl groups containing about 6–30 carbon atoms that are branched, unbranched, saturated and/or unsaturated. The one or more lower molecular weight groups include, but are not limited to, 1–12 carbon atoms that are branched, unbranched, saturated, and/or unsaturated. Specific lower molecular weight substituents include, but are not limited to, alkyls of 1 to 4 carbon atoms (e.g. methyl and ethyl), alkyl ethers, hydroxyalkyls, and/or benzyls. One or more of the higher and/or lower molecular weight substituents may include, or may be replaced by, an aryl moiety. Specific aryl moieties include, but are not limited to, benzyl, ethyl benzyl and/or phenyl. In another aspect of this embodiment, an electrically balancing anion (counterion) is linked to the positively charged nitrogen atom. Such anion includes, but is not limited to, a halide, acetate, nitrate, or lower alkosulfate. Specific anions include, but are not limited to, bromide, sulfate, iodide, alkycarboxylate, methosulfate, ethosulfate, phosphate, carboxylic acid, or chloride. In still another aspect of this embodiment, the quat is the principle biocide in the cleaning composition. In still yet another aspect of this embodiment, specific quats that can be used in the cleaning formulation include, but are not limited to, alkyl ammonium halides such as lauryl trimethyl ammonium chloride and dilauryl dimethyl ammonium chloride; alkyl aryl ammonium halides such as octadecyl dimethyl benzyl ammonium bromide; ethyl dimethyl stearyl ammonium chloride, trimethyl stearyl ammonium chloride, trimethyl cetyl ammonium chloride, dimethyl ethyl lauryl ammonium chloride, dimethyl propyl myristyl ammonium chloride, dinonyl dimethyl ammonium chloride, didecyl dimethyl ammonium chloride, diundecyl dimethyl ammonium chloride, didecyl dimethyl ammonium chloride, dinonyly ethyl ammonium chloride, dimethyl ethyl benzyl ammonium chloride, 3-(trimethyxyosilyl) propyldidecylmethyl ammonium chloride, 3-(trimethoxysilyl) propyloctadecycdimethyl ammonium chloride, dimethyl dioctyl ammonium chloride, didecyl dimethyl ammonium chloride, didodecyl dimethyl ammonium chloride, dimethyl ditetradecyl ammonium chloride, dihekadecyl dimethyl ammonium chloride, dimethyl dioctadecyl ammonium chloride, decyl dimethyl octyl ammonium chloride, dimethyl dodecyloctyl ammonium chloride, benzyl decyl dimethyl ammonium chloride, benzyl dimethyl dodecyl ammonium chloride, benzyl dimethyl tetradecyl ammonium chloride, decyl dimethyl (ethyl benzyl) ammonium chloride, decyl dimethyl (dimethyl benzyl)-ammonium chloride, (chlorobenzyl)-decyl dimethyl ammonium chloride, decyl-(dichlorobenzyl)-dimethyl ammonium chloride, benzyl didecyl methyl ammonium chloride, benzyl didocyl methyl ammonium chloride, benzyl ditetradecyl methyl ammonium chloride, benzyl dodecyl ethyl methyl ammonium chloride, and the like. Some examples of commercially available quats include didecyl dimethyl ammonium chloride, available as BTC 1010 from Stepan Chemical Co.; BARDAC 2250 from Lonza, Inc.; FMB 210-15 from Huntington; Maquat 4450-E from Mason; dialkyl dimethyl ammonium chloride, available as BTC 818 from BARDAC 2050, Inc.; FMB 302 and Maquat 40 from Mason; and/or alkyl dimethyl benzyl ammonium chloride available as BTC 835 and BARQUAT MB-50 from Lonza, Inc.; and FMB 451-5 and MC 1412 from Mason. Some quats are sold as mixtures of two or more different quats. Examples of these commercially available quat mixtures include, but are not limited to, twin chain blend/alkyl benzyl ammonium chloride compounds available as BARDAC®205M, BARDAC®208M, and BARQUAT 4250Z from Lonza, Inc.; as BTC 885, BTC 888 and BTC 2250 from Stepan Chemical Co.; as FMB 504 and FMB 504-8 from Huntington; and as MQ 615M and MQ 624M from Mason. In another embodiment, the quat content of the cleaning composition is greater than about 0.04 weight percent of the cleaning composition when the quat functions as the primary biocide in the cleaning composition. As can be appreciated, when other biocides are included with the quat in the cleaning composition, the quat content can be lower than about 0.04 weight percent of the cleaning composition. A quat content of lower than about 0.04 weight percent, when the quat functions as the primary biocide in the cleaning composition, may not eliminate a majority of common microorganisms when exposed to the cleaning composition. A quat content of about 0.04 weight percent and greater has been found to eliminate a majority, if not all, of the microorganisms that come in contact with the cleaning composition. The upper limit to the quat content of the cleaning composition can be significantly greater than about 0.04 weight percent; however, the quat content is typically limited by economic cost considerations, local, state and/or federal regulatory restrictions, formula solubility requirements, streaking properties of the cleaning composition, skin irritation considerations, and/or the intended use of the cleaning composition. Typically, the quat content of the cleaning composition is no more than about 5 weight percent. A quat content that exceeds about 5 weight percent generally results in the final product having a prohibitive cost since the quat is typically one of the higher costing components of the cleaning composition. In addition, a quat content exceeding about 5 weight percent may be subject to strict local, state and/or federal regulations due to the toxicity of the cleaning composition. However, absent the cost and regulatory barriers, the quat content can exceed about 5 weight percent when the cleaning composition is used in applications which require a high quat content. In one aspect of this embodiment, the quat content of the cleaning composition is about 0.05–5 weight percent. In another aspect of this embodiment, the quat content of the cleaning composition is about 0.08–5 weight percent. In still another aspect of this embodiment, the quat content of the cleaning composition is about 0.1–2 weight percent. In yet another aspect of this embodiment, the quat content of the cleaning composition is about 0.1–1 weight percent. In still yet another aspect of this embodiment, the quat content of the cleaning composition is about 0.15–0.8 weight percent. In a further aspect of this embodiment, the quat content of the cleaning composition is about 0.175–0.6 weight percent. In yet a further aspect of this embodiment, the quat content of the cleaning composition is about 0.2–0.5 weight percent. In still a further aspect of this embodiment, the quat content of the cleaning composition is about 0.25–0.4 weight percent.

In yet another aspect of the present invention, the cleaning composition includes an effective amount of biocide release agent to increase the amount of biocide released from the cleaning wipe onto a surface to be disinfected. It has been found that a significant amount of biocide that includes cationic compounds are retained on a cleaning wipe during use of the cleaning wipe. Typically, about 50 weight percent of the cationic biocide in the cleaning composition is retained on the cleaning wipe after use. As a result, the cationic biocide content of the cleaning composition must be increased to compensate for this high retention phenomena. As a result, the cationic biocide content is at least doubled in the cleaning composition. It has been found that one source of this retention is related to the cationic properties of the biocide and the anionic properties of the cleaning wipe. Cleaning wipes that include wood pulp, a blend of wood pulp and/or synthetic fibers that are at least partially derived from wood pulp, include several anionic species such as carboxylate, ester groups and the like. These anionic species tend to bond to the cationic biocide thereby resulting in the biocide being retained on the cleaning wipe. The biocide release agent is formulated to mitigate or prevent this bonding phenomena thereby enabling the cleaning composition to include a lower biocide content without adversely affecting the disinfecting efficacy of the cleaning wipe. The biocide release agent is a cationic compound designed to compete with the cationic biocide for the anionic species sites on the cleaning wipe thereby causing increased biocide release from the cleaning wipe during use of the cleaning wipe. The biocide release agent binds with the anionic species sites thereby freeing the cationic biocide from the cleaning wipe and allowing the biocide to be transferred to a surface to be cleaned. In one embodiment, the biocide release agent is formulated to have a higher affinity for the anionic species sites than the cationic biocide such that the site competition between the cationic biocide and the biocide release agent favors the biocide release agent. In one aspect of this embodiment, the affinity of the biocide release agent for the anionic species sites is significantly greater than the affinity of the cationic biocide for the anionic species sites thereby resulting in substantially irreversible bonding of the biocide release agent with the anionic species sites on the cleaning wipe. In another embodiment, the biocide release agent includes a cationic salt. Salts are desirable biocide release agents in that, such compounds are generally inexpensive when compared to many types of cationic biocides. A variety of different salts can be used such as, but not limited to, monovalent salts, divalent salts, organic salts, and the like. These salts include, but are not limited to, acetates, acetylides, ammonium salts (excluding quats), arsenates, astatides, azides, bihalide salts, bicarbonates, bisulfides, borides, borohydrides, borohalides, carconates, citrates, cyanates, cyanides, formates, germanates, glycinates, halates, halides, hydrides, hydroselenides, hydrosulphides, hydroxides, imides, metaniobates, metaantalates, metavanadates, nitrates, nitrides, nitrites, oxides, perchlorates, phosphates, phosphonium salts, selenides, selenites, selenates, sulphides, sulphates, ternary salts, tetraalkyl ammonium salts (excluding quats), tellurides, thiocyanates, and/or vanadates. In one aspect of this embodiment, the biocide release agent includes, but is not limited to, potassium citrate, sodium citrate, sodium tartrate, potassium tartrate, potassium lactate, sodium lactate, salicylate salts of sodium and/or potassium, magnesium sulphate, sodium chloride, ammonium chloride, and/or potassium chloride. In another embodiment, a sufficient amount of biocide release agent is included in the cleaning composition to reduce the cationic biocide retention on the cleaning wipe to less than about 50%. In one aspect of this embodiment, the cleaning composition includes a sufficient amount of biocide release agent to reduce the cationic biocide retention on the cleaning wipe to less than about 45%. In another aspect of this embodiment, the cleaning composition includes a sufficient amount of biocide release agent to reduce the cationic biocide retention on the cleaning wipe to less than about 40%. In still another aspect of this embodiment, the cleaning composition includes a sufficient amount of biocide release agent to reduce the cationic biocide retention on the cleaning wipe to less than about 35%. In yet another aspect of this embodiment, the cleaning composition includes a sufficient amount of biocide release agent to reduce the cationic biocide retention on the cleaning wipe to less than about 30%. In still yet another aspect of this embodiment, the cleaning composition includes a sufficient amount of biocide release agent to reduce the cationic biocide retention on the cleaning wipe to less than about 25%. In a further aspect of this embodiment, the cleaning composition includes a sufficient amount of biocide release agent to reduce the cationic biocide retention on the cleaning wipe to less than about 20%. In still a further aspect of this embodiment, the cleaning composition includes a sufficient amount of biocide release agent to reduce the cationic biocide retention on the cleaning wipe to less than about 15%. In yet a further aspect of this embodiment, the cleaning composition includes a sufficient amount of biocide release agent to reduce the cationic biocide retention on the cleaning wipe to less than about 10%. In still yet a further aspect of this embodiment, the cleaning composition includes a sufficient amount of biocide release agent to reduce the cationic biocide retention on the cleaning wipe to less than about 5%. In another aspect of this embodiment, the cleaning composition includes a sufficient amount of biocide release agent to reduce the cationic biocide retention on the cleaning wipe to less than about 3%. In still another aspect of this embodiment, the cleaning composition includes a sufficient amount of biocide release agent to reduce the cationic biocide retention on the cleaning wipe to less than about 1%. In still another embodiment, the biocide release agent is present in the cleaning composition such that the biocide release agent has an effective ionic strength to cause a desired amount of cationic biocide to be released from the cleaning wipe. In one aspect of this embodiment, the effective ionic strength of the biocide release agent in the cleaning composition is at least about $5\times10^{-3}$ mol/l. It has been found that an ionic strength of less than about $5\times10^{-3}$ mol/l does not result in an appreciable increase in cationic biocide release from the cleaning wipe. In another aspect of this embodiment, the effective ionic strength of the biocide release agent in the cleaning composition is about $5\times10^{-3}$–18 mol/l. In still another aspect of this embodiment, the effective ionic strength of the biocide release agent in the cleaning composition is at least about $1\times10^{-2}$ mol/l. In yet another aspect of this embodiment, the effective ionic strength of the biocide release agent in the cleaning composition is about $1\times10^{-2}$–5 mol/l. In still yet another aspect of this embodiment, the effective ionic strength of the biocide release agent in the cleaning composition is about $2\times10^{-2}$–1 mol/l. In a further aspect of this embodiment, the effective ionic strength of the biocide release agent in the cleaning composition is about $3\times10^{-2}$–0.4 mol/l. In yet a further aspect of this embodiment, the effective ionic strength of the biocide release agent in the cleaning composition is about $4\times10^{-2}$–0.2 mol/l. The weight percent of the biocide release agent in the cleaning composition to achieve a particular ionic strength in the cleaning composition is a function of the molecular weight of the biocide release agent and the ionic strength of the biocide release agent. In yet another embodiment, the biocide release agent content of the cleaning composition is at least about 0.025 weight percent and can constitute up to about 90 weight percent. In one aspect of this embodiment, the biocide release agent content of the cleaning composition is about 0.03–10 weight percent. In another aspect of this embodiment, the biocide release agent content of the cleaning composition is about 0.04–5 weight percent. In still another aspect of this embodiment, the biocide release agent content of the cleaning composition is about 0.08–3 weight percent. In yet another aspect of this embodiment, the biocide release agent content of the cleaning composition is about 0.1–2.5 weight percent. In still yet another aspect of this embodiment, the biocide release agent content of the cleaning composition is about 0.2–2.5 weight percent. In a further aspect of this embodiment, the biocide release agent content of the cleaning composition is about 0.5–2 weight percent. In still a further aspect of this embodiment, the biocide release agent content of the cleaning composition is about 0.75–1.8 weight percent.

In still another aspect of the present invention, the cleaning composition includes an effective amount of surfactant. The inclusion of the surfactant in the cleaning composition improves the cleaning performance of the cleaning composition (e.g improve wetting properties of the cleaning composition, stabilizes components in the cleaning composition, functions as an emulsifying agent, etc). A variety of surfactants can be used in the cleaning composition. Such surfactants include anionic, cationic, zwitterionic, and/or amphoteric surfactants. Many of these surfactants are described in *McCutcheon's Emulsifiers and Detergents* (1997), *Kirk-Othmer, Encyclopedia of Chemical Technology*, 3rd Ed., Volume 22, pp.332–432 (Marcel-Dekker, 1983), and *McCutcheon's Soaps and Detergents* (N. Amer. 1984), the contents of which are hereby incorporated by reference. In one embodiment, the surfactant includes, but is not limited to, glycoside, glycols, ethylene oxide and mixed ethylene oxide/propylene oxide adducts of alkylphenols, the ethylene oxide and mixed ethylene oxide/propylene oxide adducts of long chain alcohols or of fatty acids; mixed ethylene oxide/propylene oxide block copolymers, esters of fatty acids and hydrophilic alcohols, sorbitan monooleates, alkanolamides, soaps, alkylbenzene sulfonates, olefin sulfonates, paraffin sulfonates, propionic acid derivatives, alcohol and alcohol ether sulfates, phosphate esters, amines, amine oxides, alkyl sulfates, alkyl ether sulfates, sarcosinates, sulfoacetates, sulfosuccinates, coco-amphocarboxy glycinate, salts of higher acyl esters of isethionic acid, salts of higher acyl derivatives of taurine or methyltaurine, phenol poly ether sulfates, higher acyl derivatives of glycine and methylglycine, alkyl aryl poly-ether alcohols, salts of higher alkyl substituted imadazolinium dicarboxylic acids, ferchorics, tannics, naphthosulfonates, monochloracetics anthraflavinics, hippurics, anthranilics, naphthoics, phthalics, carboxylic acid salts, acrylic acids, phosphates, alkylamine ethoxylates, ethylenediamine alkoxylates, betaines, sulfobetaines, and/or imidazolines. In one aspect of this embodiment, the surfactant includes, but is not limited to, lauryl sulfate, laurylether sulfate, cocamidopropylbetaine, alkyl polyglycosides, and/or amine oxides. In another aspect of this embodiment, the surfactant includes an amine oxide having the general formula:

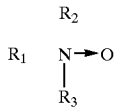

wherein $R_1$ is a $C_{6-30}$ alkyl, and $R_2$and $R_3$ are $C_{1-6}$ alkyl or hydroxyalkyl. These amine oxides can be ethoxylated and/or propoxylated. One specific amine oxide includes, but is not limited to, alkyl di (hydroxy lower alkyl) amine oxides, alkylamidopropyl di (lower alkyl) amine oxides, alkyl di (lower alkyl) amine oxides, and/or alkylmorpholine oxides, wherein the alkyl group has 5–25 carbons and can be branched, unbranched, saturated, and/or unsaturated. Non-limiting examples of amine oxides include, but are not limited to, lauryl amine oxide sold under the name Barlox 12 from Lonza. In another embodiment, the surfactant, when included in the cleaning composition, is present in an amount of at least about 0.001 weight percent of the cleaning composition. The amount of surfactant present in the cleaning composition is controlled to reduce the raw material cost of the cleaning composition and/or to restrict the dissolved actives which can contribute to residues remaining when the cleaning composition is applied to a surface. In one aspect of this embodiment, the surfactant content in the cleaning composition is about 0.01–5 weight percent. In another aspect of this embodiment, the surfactant content in the cleaning composition is about 0.05–3 weight percent. In yet another aspect of this embodiment, the surfactant content in the cleaning composition is about 0.075–2 weight percent. In still yet another aspect of this embodiment, the surfactant content in the cleaning composition is about 0.1–1 weight percent. In a further aspect of this embodiment, the surfactant content in the cleaning composition is about 0.15–0.8 weight percent. In still a further aspect of this embodiment, the surfactant content in the cleaning composition is about 0.2–0.4 weight percent. In yet a further aspect of this embodiment, the surfactant content in the cleaning composition is less than about 0.5 weight percent.

In still another aspect of the present invention, the cleaning composition includes a builder detergent. The builder detergent, when used, typically increases the effectiveness of the surfactant in the cleaning composition when a surfactant is included in the cleaning composition. The builder detergent can also function as a softener and/or a sequestering and buffering agent in the cleaning composition. A variety of builder detergents can be used in the cleaning composition. Such builder detergents include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and/or starch derivatives. In one embodiment, the builder detergent includes polyacetate and/or polycarboxylate compounds. In one aspect of this embodiment, the polyacetate and/or polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form. In another aspect of this embodiment, the builder detergent includes EDTA and/or EDTA salts. When EDTA salts are included in the cleaning composition, the EDTA salts contribute to the release of the cationic biocide from the cleaning wipe when the cleaning composition is loaded onto a cleaning wipe. The cationic properties of the EDTA salts compete for the anionic species sites on the cleaning wipe thereby causing some cationic biocide to be released from the cleaning wipe. Although the EDTA salts contribute to some cationic biocide release when sufficient amounts of EDTA salts are included in the cleaning agent, the amount of cationic biocide release attributable to the EDTA salts is very small due to the low ionic strength of the EDTA salts. Consequently, EDTA salts in the cleaning composition are not a substitute for the biocide release agent, and the absence of a biocide release agent from the cleaning composition results in little or no measurable reduction in cationic biocide retention on the cleaning wipe. In one specific aspect, the builder agent includes sodium and/or potassium salts of EDTA. In still another embodiment, the builder detergent includes substituted ammonium salts. In one aspect of this embodiment, the substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and/or propanolamine. In yet another embodiment, the cleaning composition includes at least about 0.001 weight percent builder detergent when builder detergent is included in the cleaning composition. In one aspect of this embodiment, the builder detergent content in the cleaning composition is about 0.01–2 weight percent. The concentration of the builder detergent in the cleaning composition may exceed about 2 weight percent when the cleaning composition is in a concentrated form. In another aspect of this embodiment, the builder detergent content in the cleaning composition is about 0.01–1 weight percent. In still another aspect of this embodiment, the builder detergent content in the cleaning composition is about 0.01–0.8 weight percent. In yet another aspect of this embodiment, the builder detergent content in the cleaning composition is about 0.05–0.75 weight percent. In still yet another aspect of this embodiment, the builder detergent content in the cleaning composition is about 0.05–0.5 weight percent. In a further aspect of this embodiment, the builder detergent content in the cleaning composition is about 0.07–0.3 weight percent. In still a further aspect of this embodiment, the builder detergent content in the cleaning composition is about 0.09–0.25 weight percent.

In still another aspect of the present invention, the cleaning composition includes a solvent. The solvent is used to dissolve various components in the cleaning composition so as to form a substantially uniformly dispersed mixture. In addition to the dispersion and solubilizing functions of the solvent, the solvent can function as a cleaning agent to help loosen and solubilize compounds such as greasy or oily soils from surfaces, a residue inhibiting agent to help reduce residues left behind on a cleaned surface, and/or a disinfecting agent to help eliminate various bacteria and/or viruses on a cleaned surface. In one embodiment, the solvent is water soluble and/or a dispersable organic solvent. In another embodiment, the solvent rapidly volatilizes. In one aspect of this embodiment, the solvent has a vapor pressure of at least about 0.001 mm Hg at about 25° C. In another aspect of this embodiment, the solvent volatilizes in no more than about 5 minutes at ambient temperature (about 25° C.) after contact with a surface. In another embodiment, the solvent volatilizes from a surface substantially without leaving a residue. In still another embodiment, the solvent includes, but is not limited to, $C_{1-6}$ alkanols, $C_{1-6}$ diols, $C_{1-10}$ alkyl ethers of alkylene glycols, $C_{3-24}$ alkylene glycol ethers; polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and/or pyrrolidones. In one aspect of this embodiment, the alkanol includes, but is not limited to, methanol, ethanol, n-propanol, isopropanol, butanol, pentanol, and/or hexanol, and their various positional isomers. In another aspect of this embodiment, the diols include, but are not limited to, methylene, ethylene, propylene and/or butylene glycols. In still another aspect of this embodiment, alkylene glycol ether solvents include, but are not limited to, ethylene glycol monopropyl ether, ethylene glycol monobutyl ether, propylene glycol n-propyl ether, propylene glycol monobutyl ether, propylene glycol t-butyl ether, diethylene glycol monoethyl or monopropyl or monobutyl ether, di- or tri-polypropylene glycol methyl or ethyl or propyl or butyl ether, acetate and/or propionate esters of glycol ethers. In yet another aspect of this embodiment, the short chain carboxylic acids include, but are not limited to, acetic acid, glycolic acid, lactic acid and/or propionic acid. In still yet another aspect of this embodiment, the short chain esters include, but are not limited to, glycol acetate, and/or cyclic or linear volatile methylsiloxanes. In a further aspect of this embodiment, water insoluble solvents such as isoparafinic hydrocarbons, mineral spirits, alkylaromatics, terpenoids, terpenoid derivatives, terpenes, and/or terpenes derivatives are mixed with a water soluble solvent when included in the cleaning composition. When water insoluble solvents are mixed with a water soluble solvent in the cleaning composition, the weight percentage of the water insoluble solvent in the cleaning composition is generally less than about 10 weight percent. In one specific aspect, the water insoluble solvent includes, but is not limited to, tertiary alcohols, hydrocarbons (e.g. alkanes), pine-oil, terpinoids, turpentine, turpentine derivatives, terpenoid derivatives, terpinolenes, limonenes, pinenes, terpene derivatives, benzyl alcohols, phenols, and/or their homologues. Certain terpene derivatives that can be used include, but are not limited to, d-limonene, Terpene EX, dipentene and oc-pinene. In still a further aspect of this embodiment, the pyrrolidones include, but are not limited to, N-methyl-2-pyrrolidone, N-octyl-2-pyrrolidone and/or N-dodecyl-2-pyrrolidone. In still another embodiment, the cleaning composition includes at least about 0.5 weight percent solvent when solvent is included in the cleaning composition. Typically, the cleaning composition includes at least about 0.5 weight percent solvent to avoid solubility problems which can result from the combination of various components of the cleaning composition. In one aspect of this embodiment, the solvent content in the cleaning composition is about 1–70 weight percent. In another aspect of this embodiment, the solvent content in the cleaning composition is about 2–30 weight percent. In still another aspect of this embodiment, the solvent content in the cleaning composition is about 2–10 weight percent. In yet another aspect of this embodiment, the solvent content in the cleaning composition is about 2.5–7 weight percent. In still yet another aspect of this embodiment, the solvent content in the cleaning composition is about 2.75–6 weight percent. In a further aspect of this embodiment, the solvent content in the cleaning composition is about 2.75–5 weight percent. In still a further aspect of this embodiment, the solvent content in the cleaning composition is less than about 5 weight percent.

In still yet another aspect of the present invention, the cleaning composition includes water. The water can be tap water, distilled water, deionized water, and/or industrial soft water. The amount of water in the cleaning composition depends on whether the cleaning composition is an aqueous or nonaqueous composition. In one embodiment, the water is deionized water and/or industrial soft water. The use of deionized water and/or industrial soft water reduces residue formation and limits the amount of undesirable metal ions in the cleaning composition. In another embodiment, the cleaner composition is an aqueous composition, and the water constitutes at least a majority weight percent of the cleaning composition. In one aspect of this embodiment, the water content in the cleaning composition is at least about 70 weight percent. In another aspect of this embodiment, the water content in the cleaning composition is at least about 80 weight percent. In still another aspect of this embodiment, the water content in the cleaning composition is at least about 90 weight percent. In yet another aspect of this embodiment, the water content in the cleaning composition is at least about 95 weight percent.

In a further aspect of the present invention, the cleaning composition includes one or more adjuncts. The adjuncts include, but are not limited to, buffering and pH adjusting agents, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and/or polymers. In one embodiment, the buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and/or 2-amino-2-methylpropanol. In another embodiment, the waxes, when used, include, but are not limited to, carnauba, beeswax, spermacet, candelilla, paraffin, lanolin, shellac, esparto, ouricuri, polyethylene wax, chlorinated naphthaline wax, petrolatum, microcrystalline wax, ceresine wax, ozokerite wax, and/or rezowax. In yet another embodiment, the solubilizing materials, when used, include, but are not limited to, hydrotropes (e.g. water soluble salts of low molecular weight organic acids such as the sodium and/or potassium salts of xylene sulfonic acid). In another embodiment, the acids, when used, include, but are not limited to, organic hydroxy acids, citric acids, keto acid, and the like. In still another embodiment, thickeners, when used, include, but are not limited to, polyacrylic acid, xanthan gum, calcium carbonate, aluminum oxide, alginates, guar gum, methyl, ethyl, clays, and/or propylhydroxycelluloses. In yet another embodiment, defoamers, when used, include, but are not limited to, silicones, aminosilicones, silicone blends, and/or silicone/hydrocarbon blends. In still yet another embodiment, lotions, when used, include, but are not limited to, achlorophene and/or lanolin. In a further embodiment, enzymes, when used, include, but are not limited to, lipases and proteases, and/or hydrotropes such as xylene sulfonates and/or toluene sulfonates. In a further embodiment, bleaching agents, when used, include, but are not limited to, peracids, hypohalite sources, hydrogen peroxide, and/or sources of hydrogen peroxide. In a further embodiment, preservatives, when used, include, but are not limited to, mildewstat of bacteriostat, methyl, ethyl and propyl parabens, short chain organic acids (e.g. acetic, lactic and/or glycolic acids), bisguanidine compounds (e.g. Dantagard and/or Glydant) and/or short chain alcohols (e.g. ethanol and/or IPA). In one aspect of this embodiment, the mildewstat of bacteriostat includes, but is not limited to, mildewstats (including non-isothiazolone compounds) include Kathon GC, a 5-chloro-2-methyl-4-isothiazolin-3-one, Kathon ICP, a 2-methyl-4-isothiazolin-3-one, and a blend thereof, and Kathon 886, a 5-chloro-2-methyl-4-isothiazolin-3-one, all available from Rohm and Haas Company; Bronopol, a 2-bromo-2-nitropropane 1,3diol, from Boots Company Ltd.; Proxel CRL, a propyl-p-hydroxybenzoate, from ICI PLC; Nipasol M, an o-phenylphenol, Na+salt, from Nipa Laboratories Ltd.; Dowicide A, a 1,2-Benzoisothiazolin-3-one, from Dow Chemical Co.; and Irgasan DP 200, a 2,4,4'-trichloro-2-hydroxydiphenylether, from Ciba-Geigy A. G. In still a further embodiment, polymers, when used, include, but are not limited to, polysaccharides, polycarboxylates, polystyrenesulfonates, acrylate polymers, polyethyleneimines, polyvinylpyrrolidones, methylvinyl ether, polyvinyl alcohols,. silicones, and/orpolyethylene glycols. In one aspect of this embodiment, the polymer, when used, is generally a water soluble or dispersable polymer having a molecular weight of generally below 2,000,000 daltons. In another aspect of this embodiment, polysaccharide polymers include, but are not limited to, substituted cellulose materials like carboxymethylcellulose, ethyl cellulose, hydroxyethylcellulose, hydroxypropylcellulose, hydroxymethylcellulose, succinoglycan and naturally occurring polysaccharide polymers like xanthan gum, guar gum, locust bean gum, tragacanth gum or derivatives thereof, sodium casceinate, gelatin, cationic cellulose ether, and/or Polymer JR. In still another aspect of this embodiment, polycarboxylates include, but are not limited to, ethylene, simple olefin, styrene, alphamethylstyrene, methyl, ethyl and $C_{3-8}$ alkyl acrylates and methacrylates, isobomyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates, acrylic acid, methacrylic acid, polycarboxylic acids, sulfonic acids, phosphoric acids, maleic anhydride, ethylene and/or propylene. In yet another aspect of this embodiment, polystyrenesulfonates include, but are not limited to, Flexan 130, Versa TL-4, and/or Versa TL501 from ALCO Corporation. In still another aspect of this embodiment, acrylate polymers include, but are not limited to, cationic acrylic water soluble polymers that are copolymers of cationic quaternized acrylates, methacrylates, acrylamides, and methacrylamides; and/or copolymers of one or more acidic monomers such as acrylic acid, methacrylic acid or maleic anhydride with at least one other ethylenically unsaturated monomer selected from a group of ethylene and other simple olefin, styrene, alphamethylstyrene, methyl, ethyl and $C_3$ to $C_8$ alkyl acrylates and methacrylates, isobornyl methacrylate, acrylamide, hydroxyethyl acrylate and methacrylate, hydroxypropyl acrylate and methacrylate, N-vinyl pyrrolidone, butadiene, isoprene, vinyl halides such as vinyl chloride and vinylidine chloride, alkyl maleates, alkyl fumarates, fumaric acid, maleic acid, itaconic acid, acetoacetoxy methacrylate or other acetoacetate monomers, and/or divinyl or polyvinyl monomers, such as glycol polyacrylates, allyl methacrylate, and divinyl benzene. In a further aspect of this embodiment, polyvinylpyrrolidone includes, but is not limited to, copolymers of N-vinylpyrrolidone with one or more aklylenically unsaturated monomers such as unsaturated dicarboxylic acids such as maleic acid, chloromaleic acid, fumaric acid, itaconic acid, citraconic acid, phenylmaleic acid, aconitic acid, acrylic acid, methacrylic acid, N-vinylimidazole, vinylcaprolactam, butene, hexadecene, and vinyl acetate. In addition, any of the esters and amides of the unsaturated acids may be employed, for example, methyl acrylate, ethylacrylate, acrylamide, methacryamide, dimethylaminoethylmethacrylate, dimethylaminopropylmethacrylamide, trimethylammoniumethylmethacrylate, and trimethylammoniumpropylmethacrylamide. Other suitable alkylencially unsaturated monomers include aromatic monomers such as styrene, sulphonated styrene, alpha-methylstyrene, vinyltoluene, t-butylstyrene and others. In yet a further aspect of this embodiment, the silicones include, but are not limited to, polysicoxanes.

The principal object of the present invention is to provide an cleaning composition having improved cleaning attributes.

Another and/or alternative object of the present invention is to provide an cleaning composition having improved disinfecting, sanitizing, and/or sterilizing properties.

Yet another and/or alternative object of the present invention is to provide an cleaning composition that can be loaded on a cleaning wipe.

Still another and/or alternative object of the present invention is to provide an cleaning composition that exhibits improved biocidal release from a cleaning wipe.

Still yet another and/or alternative object of the present invention is to provide an cleaning composition having a reduced solvent content.

Another and/or alternative object of the present invention is to provide an cleaning composition having a reduced toxicity without impairing the disinfecting attributes of the cleaning composition.

Yet another and/or alternative object of the present invention is to provide an cleaning composition having a reduced raw material cost.

Still another and/or alternative object of the present invention is to provide an cleaning composition that exhibits reduced streaking and/or filming.

These and other objects and advantages will become apparent to those skilled in the art upon reading and following the description of the invention taken together with the accompanied drawing.

BRIEF DESCRIPTION OF THE DRAWING

Reference may now be made to the drawing, which illustrates various attributes of the invention wherein.

DETAILED DESCRIPTION OF THE PREFERRED EMBODIMENTS

Figure 1:
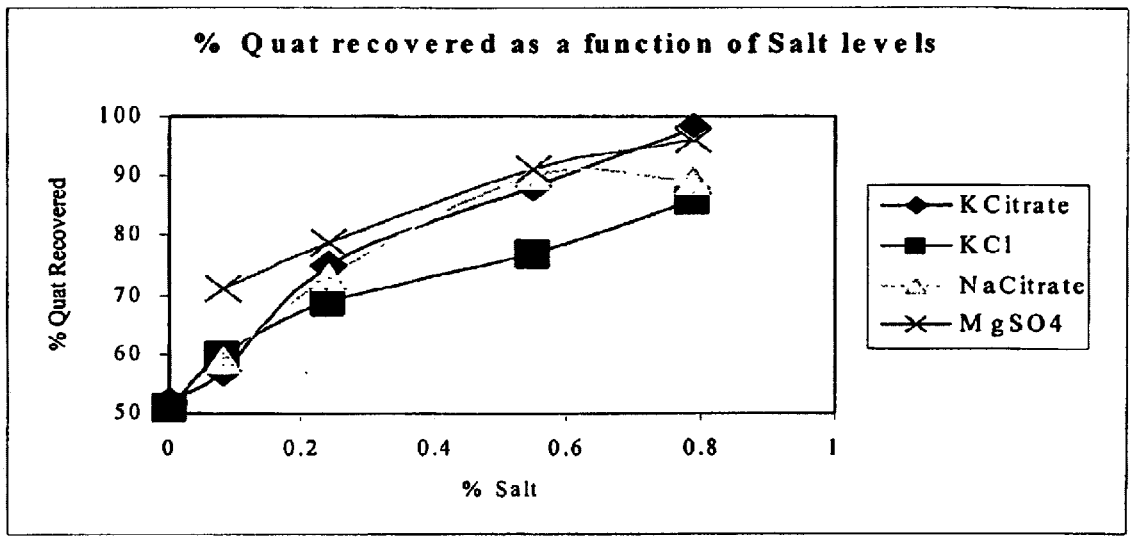
FIG. 1 is a graphical illustration of the percentage of quat recovered from the cleaning wipe as a function of the weight percentage of salts in the cleaning composition.

The improved cleaning composition of the present invention can be used independently from or in conjunction with an absorbent material. The cleaning composition is particularly formulated to be loaded onto a cleaning wipe which cleaning wipe includes wood pulp and/or wood pulp derivatives and will be described with particular reference thereto.

The cleaning composiiton is loaded onto a cleaning wipe which is made of an absorbent/adsorbent material. Typically, the cleaning wipe has at least one layer of nonwoven material. Nonlimiting examples of commercially available cleaning wipes that can be used include DuPont 8838, Dexter ZA, Dexter 10180, Dexter M10201. All of these cleaning wipes include a blend of polyester and wood pulp. Dexter M10201 also includes rayon, a wood pulp derivative. The loading ratio of the cleaning composition onto the cleaning wipe is about 2–5:1, and typically about 3–4:1. The cleaning composition is loaded onto the cleaning wipe in any number of manufacturing methods. Typically, the cleaning wipe is soaked in the cleaning composition for a period of time until the desired amount of loading is achieved. The cleaning wipe loaded with the cleaning composition provides excellent cleaning with little or no streaking/filming.

The basic components of the aqueous cleaning composition include:

(i) a biocide;

(ii) a biocide release agent; and (iii) water.

Additional components can be included in the cleaning composition to add one or more attributes to the cleaning composition and/or to enhance the attributes of the cleaning composition.

The biocide in the cleaning composition includes a cationic compound. The cationic biocide typically one or more quaternary ammonium compounds (quats). Quats are desirable in that such compounds have a broad spectrum antimicrobial or germicidal properties. A variety of different quats can be used in the cleaning composition. The general structure for the quat is:

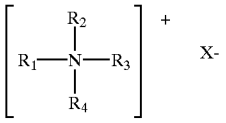

wherein X is an anion such as chloride, bromide, iodide, carbonate and/or an alkyl carboxylate; and $R_1$–$R_4$ are straight chain, branched chain and/or cyclic chain groups. Typically the quat is an alkyldimethylbenzylammonium quat, an alkyldimethylethylbenzylammonium quat and/or an alkyldimethylammonium quat. One particular nonlimiting quat that can be used in the cleaning composition is a combination of alkyldimethylbenzylammonium chloride ($C_{14}$–60%, $C_{16}$–30%, $C_{12}$–5%, $C_{18}$–5%) and alkyldimethylethylbenzylammonium chloride ($C_{12}$–68%, $C_{14}$–32%). This quat combination is commercially available as Barquat 4250Z by Lonza.

The quat content of the cleaning composition is typically maintained above about 0.04 weight percent and less than about 5 weight percent. Generally, the quat content of the cleaning composition is about 0.1–0.5 weight percent. This weight percentage range for the quat in the cleaning composition is selected to disinfect most common household and industrial surfaces. Ccommon types of bacteria that are destroyed by the cleaning composition include, but are not limited to, staphylococcus aureus (Staph) and/or salmonella choleraesuis (salmonella).

The biocide release agent used in the cleaning composition includes a cationic compound that is designed to compete with the cationic biocide for anionic species sites on the cleaning wipe. The cationic biocide release agent typically includes a cationic salt. Generally, a commonly available salt is used so as to minimize the raw material cost of the cleaning composition. In addition, a salt having a relatively high ionic strength per mole of salt is selected to minimize the amount of salt needed in the cleaning composition thereby also minimizing the raw material cost of the cleaning composition. Nonlimiting examples of salts that can be used in the cleaning composition include potassium citrate, sodium citrate, magnesium sulphate, sodium chloride, ammonium chloride, and/or potassium chloride. The one or more salts are added to the cleaning composition in an amount to cause over about 50% of the cationic biocide to be released from the cleaning wipe when the cleaning wipe is applied to a surface to be cleaned. Generally, the salt content of the cleaning composition is sufficient to cause at least about 75% of the cationic biocide to release from the cleaning wipe. Typically, the ionic strength of the one or more salts in the cleaning composition is about $1\times10^{-2}$–2 mol/l, and the weight percent of the salt in the cleaning composition is about 0.04–5 weight percent.

The water used in the ready to use cleaning composition constitutes a majority of the cleaning composition. Typically, the aqueous cleaning composition includes at least about 80 weight percent water. The water is typically deionized water and/or industrial soft water so as to reduce residue formation and limit the amount of undesirable metal ions in the cleaning composition.

The cleaning composition typically includes a builder detergent, solvent, and/or surfactant. The builder detergent is used to increase the effectiveness of the surfactant in the cleaning composition, as a softener and/or as a sequestering and buffering agent in the cleaning composition. Typically, the builder detergent includes sodium and/or potassium salts of EDTA. The builder detergent content, when used in the cleaning composition, is typically about 0.01–0.8 weight percent. The solvent is used as a dispersion and solubilizing agent for the components of the cleaning composition, as a cleaning agent to help loosen and solubilize compounds, a residue inhibiting agent, and/or a secondary disinfecting agent. Typically the solvent is an alkanol such as methanol, ethanol, n-propanol, isopropanol, butanol, pentanol, and/or hexanol. The amount of solvent in the cleaning composition is generally limited to less than 10 weight percent of the cleaning composition and typically less than about 5 weight percent of the cleaning composition. A variety of anionic, cationic and/or amphoteric surfactants can be included in the cleaning composition. Typically the surfactant includes amine oxide. Generally, the surfactant content of the cleaning composition is about 0.01–5 weight percent.

A general formulation of the cleaning composition in weight percent is as follows:

| | |
|---|---|
| Biocide | 0.05–5% |
| Biocide release agent | 0.03–10% |
| Water | at least 5% |

wherein the ionic strength of the biocide release agent is at least about $5\times10^{-3}$ mol/l.

Several specific, nonlimiting, examples of the cleaning composition in weight percent are as follows:

EXAMPLE 1

| | |
|---|---|
| Biocide | 0.05–5% |
| Biocide release agent | 0.03–10% |
| Builder detergent | 0.001–10% |
| Solvent | 0.5–99% |
| Surfactant | 0.001–10% |
| Water | at least 10% |

wherein the ionic strength of the biocide release agent is at least about $5\times10^{-3}$ mol/l.

EXAMPLE 2

| | |
|---|---|
| Biocide | 0.1–2% |
| Biocide release agent | 0.08–3% |
| Builder detergent | 0.01–2% |
| Solvent | 2–30% |
| Surfactant | 0.05–3% |
| Water | at least 60% |

wherein the ionic strength of the biocide release agent is at least about $1\times10^{-2}$ mol/l.

EXAMPLE 3

| | |
|---|---|
| Biocide | 0.15–0.8% |
| Biocide release agent | 0.1–2.5% |
| Builder detergent | 0.01–0.8% |
| Solvent | 2–10% |
| Surfactant | 0.075–2% |
| Water | at least 80% |

wherein the ionic strength of the biocide release agent is about $2\times10^{-2}$–1 mol/l.

EXAMPLE 4

| | |
|---|---|
| Biocide | 0.2–0.5% |
| Biocide release agent | 0.5–2% |
| Builder detergent | 0.05–0.5% |
| Solvent | 2.75–8% |
| Surfactant | 0.15–0.8% |
| Water | at least 85% |

wherein the ionic strength of the biocide release agent is about $3\times10^{-2}$–0.4 mol/l.

EXAMPLE 5

| | |
|---|---|
| Biocide | 0.25–0.4% |
| Biocide release agent | 0.75–1.8% |
| Builder detergent | 0.075–0.25% |
| Solvent | 2.75–5% |
| Surfactant | 0.2–0.4% |
| Water | at least 85% |

wherein the ionic strength of the biocide release agent is about $4\times10^{-2}$–0.2 mol/l.

EXAMPLE 6

| | |
|---|---|
| BARQUAT 4250Z | 0.3–0.4% |
| Potassium Citrate | 0.09–1.1% |
| Disodium EDTA | 0.09–0.15% |
| Isopropanol | 3.5–5% |
| Lauryl Dimethly Amine Oxide | 0.2–0.4% |
| Fragrance | 0–1% |
| Water | at least 90% |

wherein the ionic strength of the salts in the cleaning composition is about $3.5\times10^{-2}$–$5\times10^{-2}$ mol/l.

EXAMPLE 7

| | |
|---|---|
| BTC 2250 | 0.3–0.4% |
| Sodium Citrate | 0.9–1.1% |
| DiPotassium EDTA | 0.09–0.15% |
| Isopropanol | 3.5–5% |
| Lauryl Dimethly Amine Oxide | 0.2–0.4% |
| Water | at least 90% |

wherein the ionic strength of the salts in the cleaning composition is about $3.75\times10^{-2}$–$5.4\times10^{-2}$ mol/l.

Several specific, nonlimiting examples of the cleaning composition loaded onto a cleaning wipe in weight percentage of the loaded cleaning wipe are as follows:

EXAMPLE 8

| | |
|---|---|
| Biocide | 0.025–4.17% |
| Biocide release agent | 0.015–8.33% |
| Builder detergent | 0.0005–1.67% |
| Solvent | 0.25–58.3% |
| Surfactant | 0.0005–4.17% |
| Water | at least 5% |
| Dry cleaning wipe | 16.7–50% |
| Loading ratio | 1–5:1 |

wherein the ionic strength of the biocide release agent is at least about $5\times10^{-3}$ mol/l.

EXAMPLE 9

| | |
|---|---|
| Biocide | 0.1–0.64% |
| Biocide release agent | 0.067–2% |
| Builder detergent | 0.0067–0.64% |
| Solvent | 1.3–8% |
| Surfactant | 0.05–1.6% |
| Water | at least 53% |
| Dry cleaning wipe | 20–33% |
| Loading ratio | 2–4:1 |

wherein the ionic strength the biocide release agent is at least about $2\times10^{-2}$ mol/l.

EXAMPLE 10

| | |
|---|---|
| BARQUAT 4250Z | 0.23–0.32% |
| Potassium Citrate | 0.1–0.88% |
| Disodium EDTA | 0.07–0.12% |
| Isopropanol | 2.7–4% |
| Barlox 12 | 0.155–0.32% |
| Water | at least 70% |
| DuPont 8838 | 20–22.2% |
| Loading ratio | 3.5–4:1 |

wherein the ionic strength of the salts in the cleaning composition is about $3.5\times10^{-2}$–$5\times10^{-2}$ mol/l.

The inclusion of a cationic biocide release agent in the cleaning composition positively affects the cationic biocide retention in a cleaning wipe. As illustrated in Table 1 below, and in FIG. 1, the increase in salt content of the cleaning composition results in a decrease in quat retention and an increase in quat recovery. Several trials were conducted using two types of cleaning wipes and five different types of biocide release agents. The quat used in the cleaning composition was BARQUAT 4250Z by Lonza. The cleaning composition included about 0.37 weight percent biocide, about 0.3 weight percent amine oxide, about 0.1 weight percent sodium EDTA, 4.9 weight percent isopropanol, and the balance water. Each cleaning wipe had a loading ratio of cleaning composition to cleaning wipe of about 3.75:1.

TABLE 1

| | Quat Bactericidal Wipe Effective of Salts on Quat Released (Quat level = 0.29%) | | | | |
|---|---|---|---|---|---|
| % Salt | % Quat Recovery with K-Citrate (DuPont 8838) | % Quat Recovery with KCl (DuPont 8838) | % Quat Recovery with Na-Citrate (DuPont 8838) | % Quat Recovery with $MgSO_4$ (DuPont 8838) | % Quat Recovery with $NH_4Cl$ (Dexter ZA) |
| 0 | 52 | 51 | | | |
| 0.00304 | | | | | 67.4 |
| 0.00595 | | | | | 73.1 |
| 0.1013 | 57 | 60 | 59 | 71 | 75.9 |
| 0.304 | 75 | 69 | 73 | 79 | 82.1 |
| 0.697 | 88 | 77 | 90 | 91 | 82.4 |
| 1.0 | 98 | 86 | 89 | 96 | 96.3 |

As illustrated above, the quat retention on the cleaning wipe is about 50% when the salt was not added to the cleaning composition. The results in Table 1 illustrate that the quat retention is substantially reduced by increasing the concentration of salt in the cleaning composition. The variances in measured quat retention are believed to be due to the type of cleaning wipe used and the ionic strength of the salt. In every test, the inclusion of salt in the cleaning composition resulted in an increased quat release from the cleaning wipe. FIG. 1 graphically illustrates the quat retention on a DuPont 8838 cleaning wipe as a function of the salt content of the cleaning composition.

Another set of tests were conducted to determine if there was any effect on the quat release levels from the cleaning wipe as a function of the type of cleaning wipe. The results of these tests are illustrated in Table 2. The biocide used in the cleaning composition was BARQUAT 4250Z by Lonza. The cleaning composition included about 0.3 weight percent amine oxide, about 0.1 weight percent sodium EDTA, about 4.9 weight percent isopropanol, and the balance water. The biocide release agent used was potassium citrate. Two concentrations of potassium citrate were used, namely, 1.0 and 0.304 weight percent of the cleaning composition. The cleaning wipe was DuPont 8838 having a loading ratio of cleaning composition to cleaning wipe of about 3.75:1.

TABLE 2

| Effect of Different Cleaning Wipes on Quat Released using K Citrate | |
|---|---|
| Cleaning Wipe | % Quat Released |
| Dexter 10180 (0.24% K Citrate) | 78 |
| Dexter M10201 (0.24% K Citrate) | 93 |
| Dexter ZA (0.24% K Citrate) | 83 |
| Dexter 10180 (0.79% K Citrate) | 100 |
| Dexter M10201 (0.79% K Citrate) | 100 |
| Dexter ZA (0.79% K Citrate) | 100 |

The test results in Table 2 reveal that an increase in quat release from the cleaning wipe occurred regardless of the type of wood pulp containing cleaning wipe. In addition, the test results confirmed that increased salt concentrations in the cleaning composition resulted in decreased quat retention.

Another set of tests were conducted to determine if there was any affect on the quat release as a function of the amount of quat in the cleaning composition. The results of these tests are illustrated in Table 3. The biocide used in the cleaning composition was BARQUAT 4250Z by Lonza. The cleaning composition included about 0.3 weight percent amine oxide, about 1 weight percent potassium citrate, about 0.1 weight percent sodium EDTA, about 4.9 weight percent isopropanol, and the balance water. The cleaning wipe was DuPont 8838 having a loading ratio of cleaning composition to cleaning wipe of about 3.75:1.

TABLE 3

| Effect of different quat levels on quat released (K citrate = 1.0%) | |
|---|---|
| % Quat in Cleaning composition | % K-citrate = 1.0% |
| 0 | N/A |
| 0.507 | 100% |
| 0.101 | 99.6% |
| 0.203 | 95.8% |
| 0.279 | 94.2% |
| 0.367 | 95.2% |

The results in Table 3 indicate that the amount of quat compound release is not adversely affected by the amount of quat in the cleaning composition.

Several tests were also conducted to determine whether the salt in the cleaning agent adversely affected the bactericidal efficacy of the cleaning composition. In each test conducted, the salt did not adversely affect the bactericidal efficacy of the cleaning composition. In addition, it was found that the salts alone had little or no bactericidal efficacy.

The invention has been described with reference to a preferred embodiment and alternates thereof. It is believed that many modifications and alterations to the embodiments disclosed will readily suggest itself to those skilled in the art upon reading and understanding the detailed description of the invention. It is intended to include all such modifications and alterations insofar as they come within the scope of the present invention.

We claim:

1. A hard surface cleaning composition adapted to be loaded on a cleaning wipe comprising about 0.05–5 eight percent cationic biocide as the principal biocide, a cationic biocide release agent having an ionic strength in said cleaning composition of about $1\times10^{-2}$–5 mol/l and constituting about 0.04–5 weight percent of said cleaning composition, about 0.01–5 weight percent surfactant, about 0.5 to less than about 5 weight percent organic solvent, and a majority weight percent water, said cationic biocide including a quaternary ammonium compound, said cationic biocide release agent including a salt selected from the group consisting of potassium citrate, sodium citrate, magnesium sulphate, sodium chloride, ammonium chloride, potassium chloride and mixtures thereof, said surfactant including an amine oxide, a majority of said organic solvent including a solvent selected from a group consisting of methanol, ethanol, n-propanol, isopropanol, butanol, pentanol, hexanol and mixtures thereof.

2. The improved cleaning composition as defined in claim 1, including 0.01–2 weight percent builder detergent, said builder detergent including a compound selected from a group consisting of sodium EDTA, disodium EDTA, potassium EDTA, dipotassium EDTA, and mixtures thereof.

3. The improved cleaning composition as defined in claim 1, comprising:

| | |
|---|---|
| Biocide | 0.25–0.4% |
| Biocide release agent | 0.75–1.8% |
| Solvent | at least 2.75% |
| Surfactant | 0.2–0.4% |
| Builder detergent | 0–0.25% |
| Water | at least 85% |

wherein the ionic strength of the biocide release agent is about $4\times10^{-2}$–0.2 mol/l.

4. The improved cleaning composition as defined in claim 2, comprising:

| | |
|---|---|
| Biocide | 0.25–0.4% |
| Biocide release agent | 0.75–1.8% |
| Solvent | at least 2.75% |
| Surfactant | 0.2–0.4% |
| Builder detergent | 0–0.25% |
| Water | at least 85% |

wherein the ionic strength of the biocide release agent is about $4\times10^{-2}$–0.2 mol/l.

5. The improved cleaning composition as defined in claim 1, comprising:

| | |
|---|---|
| BARQUAT 4250Z/BTC 2250 | 0.3–0.4% |
| Potassium Citrate/Sodium Citrate | 0.09–1.1% |
| Isopropanol | at least 3.5% |
| Lauryl Dimethyl Amine Oxide | 0.2–0.4% |
| Disodium EDTA/Dipotassium EDTA | 0–0.15% |
| Fragrance | 0–1% |
| Water | at least 90% |

wherein the ionic strength of the salts in the cleaning composition is about $3.5\times10^{-2}$–$5\times10^{-2}$ mol/l.

6. The improved cleaning composition as defined in claim 2, comprising:

| | |
|---|---|
| BARQUAT 4250Z/BTC 2250 | 0.3–0.4% |
| Potassium Citrate/Sodium Citrate | 0.09–1.1% |
| Isopropanol | at least 3.5% |
| Lauryl Dimethyl Amine Oxide | 0.2–0.4% |
| Disodium EDTA/Dipotassium EDTA | 0–0.15% |
| Fragrance | 0–1% |
| Water | at least 90% |

wherein the ionic strength of the salts in the cleaning composition is about $3.5\times10^{-2}$–$5\times10^{-2}$ mol/l.

7. The improved cleaning composition as defined in claim 1, comprising:

| | |
|---|---|
| BARQUAT 4250Z/BTC 2250 | 0.3–0.4% |
| Potassium Citrate/Sodium Citrate | 0.09–1.1% |
| Disodium EDTA/DiPotassium EDTA | 0.09–0.15% |
| Isopropanol | at least 3.5% |
| Lauryl Dimethyl Amine Oxide | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

8. The improved cleaning composition as defined in claim 2, comprising:

| | |
|---|---|
| BARQUAT 4250Z/BTC 2250 | 0.3–0.4% |
| Potassium Citrate/Sodium Citrate | 0.09–1.1% |
| Disodium EDTA/DiPotassium EDTA | 0.09–0.15% |
| Isopropanol | at least 3.5% |
| Lauryl Dimethyl Amine Oxide | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

9. The improved cleaning composition as defined in claim 1, comprising:

| | |
|---|---|
| BARQUAT 4250Z | 0.23–0.32% |
| Potassium Citrate | 0.1–0.88% |
| Disodium EDTA | 0.07–0.12% |
| Isopropanol | at least 2.7% |
| Barlox 12 | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

10. The improved cleaning composition as defined in claim 2, consists essentially of:

| | |
|---|---|
| BARQUAT 4250Z | 0.23–0.32% |
| Potassium Citrate | 0.1–0.88% |
| Disodium EDTA | 0.07–0.12% |
| Isopropanol | at least 2.7% |
| Barlox 12 | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

11. A disinfecting cleaning wipe having reduced biocide retention comprising:

a. a wipe having at least one layer of absorbent or adsorbent material, said wipe including a material selected from a group consisting of wood pulp, wood pulp derivative, and mixtures thereof; and b. a hard surface cleaning composition impregnated on said wipe with a loading ratio of about 1–5:1, said hard surface cleaning composition including about 0.05–5 weight percent cationic biocide as the principal biocide, a cationic biocide release agent to reduce the cationic biocide retention on said wipe to less than about 45% wherein the cationic biocide release agent has an ionic strength in said cleaning composition of about $1\times10^{-}$ 2–5 mol/l and constituting about 0.04–5 weight percent of said cleaning composition, about 0.01–5 weight percent surfactant, about 0.5 to less than about 5 weight percent organic solvent, and a majority weight percent water, said cationic biocide including a quaternary ammonium compound, said cationic biocide release agent including a salt selected from the group consisting of potassium citrate, sodium citrate, magnesium sulphate, sodium chloride, ammonium chloride, potassium chloride and mixtures thereof, said surfactant including an amine oxide, a majority of said organic solvent including a solvent selected from a group consisting of methanol, ethanol, n-propanol, isopropanol, butanol, pentanol, hexanol and mixtures thereof.

12. The disinfecting cleaning wipe as defined in claim 11, wherein said cationic biocide release agent reduces the cationic biocide retention on said wipe to less than about 30%.

13. The disinfecting cleaning wipe as defined in claim 11, including 0.01–2 weight percent builder detergent, said builder detergent including a compound selected from a group consisting of sodium EDTA, disodium EDTA, potassium EDTA, dipotassium EDTA, and mixtures thereof.

14. The disinfecting cleaning wipe as defined in claim 12, including 0.01–2 weight percent builder detergent, said builder detergent including a compound selected from a group consisting of sodium EDTA, disodium EDTA, potassium EDTA, dipotassium EDTA, and mixtures thereof.

15. The cleaning wipe as defined in claim 11, wherein said cleaning composition comprises:

| | |
|---|---|
| Biocide | 0.25–0.4% |
| Biocide release agent | 0.75–1.8% |
| Solvent | at least 2.75% |
| Surfactant | 0.2–0.4% |
| Builder detergent | 0–0.25% |
| Water | at least 85% |

wherein the ionic strength of the biocide release agent is about $4\times10^{-2}$–0.2 mol/l.

16. The cleaning wipe as defined in claim 14, wherein said cleaning composition comprises:

| | |
|---|---|
| Biocide | 0.25–0.4% |
| Biocide release agent | 0.75–1.8% |
| Solvent | at least 2.75% |
| Surfactant | 0.2–0.4% |
| Builder detergent | 0–0.25% |
| Water | at least 85% |

wherein the ionic strength of the biocide release agent is about $4\times10^{-2}$–0.2 mol/l.

17. The cleaning wipe as defined in claim 11, wherein said cleaning composition comprises:

| | |
|---|---|
| BARQUAT 4250Z/BTC 2250 | 0.3–0.4% |
| Potassium Citrate/Sodium Citrate | 0.09–1.1% |
| Isopropanol | at least 3.5% |
| Lauryl Dimethyl Amine Oxide | 0.2–0.4% |
| Disodium EDTA/Dipotassium EDTA | 0–0.15% |

-continued

| | |
|---|---|
| Fragrance | 0–1% |
| Water | at least 90% |

wherein the ionic strength of the salts in the cleaning composition is about $3.5\times10^{-2}$–$5\times10^{-2}$ mol/l.

18. The cleaning wipe as defined in claim 14, wherein said cleaning composition comprises:

| | |
|---|---|
| BARQUAT 4250Z/BTC 2250 | 0.3–0.4% |
| Potassium Citrate/Sodium Citrate | 0.09–1.1% |
| Isopropanol | at least 5% |
| Lauryl Dimethyl Amine Oxide | 0.2–0.4% |
| Disodium EDTA/Dipotassium EDTA | 0–0.15% |
| Fragrance | 0–1% |
| Water | at least 90% |

wherein the ionic strength of the salts in the cleaning composition is about $3.5\times10^{-2}$–$5\times10^{-2}$ mol/l.

19. The cleaning wipe as defined in claim 11, wherein said cleaning composition comprises:

| | |
|---|---|
| BARQUAT 4250Z/BTC 2250 | 0.3–0.4% |
| Potassium Citrate/Sodium Citrate | 0.09–1.1% |
| Disodium EDTA/DiPotassium EDTA | 0.09–0.15% |
| Isopropanol | at least 3.5% |
| Lauryl Dimethyl Amine Oxide | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

20. The cleaning wipe as defined in claim 14, wherein said cleaning composition comprises:

| | |
|---|---|
| BARQUAT 4250Z/BTC 2250 | 0.3–0.4% |
| Potassium Citrate/Sodium Citrate | 0.09–1.1% |
| Disodium EDTA/DiPotassium EDTA | 0.09–0.15% |
| Isopropanol | at least 3.5% |
| Lauryl Dimethyl Amine Oxide | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

21. The cleaning wipe as defined in claim 11, wherein said cleaning composition comprises:

| | |
|---|---|
| BARQUAT 4250Z | 0.23–0.32% |
| Potassium Citrate | 0.1–0.88% |
| Disodium EDTA | 0.07–0.12% |
| Isopropanol | 2.7–4% |
| Barlox 12 | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

22. The cleaning wipe as defined in claim 14, wherein said cleaning composition consists essentially of:

| | |
|---|---|
| BARQUAT 4250Z | 0.23–0.32% |
| Potassium Citrate | 0.1–0.88% |
| Disodium EDTA | 0.07–0.12% |
| Isopropanol | 2.7–4% |
| Barlox 12 | 0.2–0.4% |
| Fragrance | 0–1% |
| Water | at least 90% |

wherein the ionic strength of the salts in the cleaning composition is about $3.75\times10^{-2}$–$5.4\times10^{-2}$ mol/l.

23. A dispenser for cleaning wipes comprising a container containing at least one cleaning wipe, said cleaning wipe including a wipe impregnated with an improved cleaning composition, said wipe having at least one layer of absorbent or adsorbent material, said wipe including a material selected from a group consisting of wood pulp, wood pulp derivative and mixtures thereof, said improved cleaning composition including about 0.05–5 weight percent cationic biocide as the principal biocide, a cationic biocide release agent to reduce the cationic biocide retention on said wipe to less than about 45% wherein the cationic biocide release agent has an ionic strength in said cleaning composition of about $1\times10^{-2}$–5 mol/l and constituting about 0.04–5 weight percent of said cleaning composition, about 0.01–5 weight percent surfactant, about 0.5 to less than about 5 weight percent organic solvent, and a majority weight percent water, said cationic biocide including quaternary ammonium compound, said cationic biocide release agent including a salt selected from the group consisting of potassium citrate, sodium citrate, magnesium sulphate, sodium chloride ammonium chloride, potassium chloride and mixtures thereof, said surfactant including an amine oxide, a majority of said organic solvent including a solvent selected from a group consisting of methanol, ethanol, n-propanol, isopropanol, butanol, pentanol, hexanol and mixtures thereof.

24. The dispenser for cleaning wipes as defined in claim 23, including 0.01–2 weight percent builder detergent, said builder detergent including a compound selected from a group consisting of sodium EDTA, disodium EDTA, potassium EDTA, dipotassium EDTA, and mixtures thereof.

25. The dispenser for cleaning wipes as defined in claim 23, wherein said improved cleaning composition includes:

| | |
|---|---|
| BARQUAT 4250Z/BTC 2250 | 0.3–0.4% |
| Potassium Citrate/Sodium Citrate | 0.09–1.1% |
| Isopropanol | at least 3.5% |
| Lauryl Dimethyl Amine Oxide | 0.2–0.4% |
| Disodium EDTA/Dipotassium EDTA | 0–0.15% |
| Fragrance | 0–1% |
| Water | at least 90% |

wherein the ionic strength of the salts in the cleaning composition is about $3.5\times10^{-2}$–$5\times10^{-2}$ mol/l.

26. Th dispenser for cleaning wipes as defined in claim 24, wherein said improved cleaning composition consists essentially of:

| | |
|---|---|
| BARQUAT 4250Z/BTC 2250 | 0.3–0.4% |
| Potassium Citrate/Sodium Citrate | 0.09–1.1% |
| Isopropanol | at least 3.5% |
| Lauryl Dimethyl Amine Oxide | 0.2–0.4% |
| Disodium EDTA/Dipotassium EDTA | 0–0.15% |
| Fragrance | 0–1% |
| Water | at least 90% |

wherein the ionic strength of the salts in the cleaning composition is about $3.5\times10^{-2}$–$5\times10^{-2}$ mol/l.

* * * * *